US005096514A

United States Patent [19]

Watanabe et al.

[11] Patent Number: 5,096,514

[45] Date of Patent: Mar. 17, 1992

[54] HEAT-RESISTANT FERRITIC CAST STEEL HAVING EXCELLENT THERMAL FATIGUE RESISTANCE

[75] Inventors: Rikizo Watanabe; Koji Sato, both of Yasugi, Japan

[73] Assignee: Hitachi Metals, Ltd., Tokyo, Japan

[21] Appl. No.: 648,133

[22] Filed: Jan. 30, 1991

[30] Foreign Application Priority Data

Jan. 31, 1990 [JP] Japan ..... 2-021777

[51] Int. Cl.[5] ..... C22C 38/18; C22C 38/30

[52] U.S. Cl. ..... 148/325; 420/36; 420/40

[58] Field of Search ..... 420/36, 37, 38, 40; 148/325

[56] References Cited

U.S. PATENT DOCUMENTS 3,820,981 6/1974 Wilde ..... 420/37
3,969,109 7/1976 Tanczyn ..... 420/40

FOREIGN PATENT DOCUMENTS 2032366 11/1970 France .
2281994 12/1976 France .
46-18845 5/1971 Japan .
48-52618 7/1973 Japan .
54-18647 7/1979 Japan .
55-164064 12/1980 Japan ..... 420/40
56-00250 1/1981 Japan ..... 420/40
56-41354 4/1981 Japan .
57-85952 5/1982 Japan ..... 420/40
61-117251 6/1986 Japan .
62-17021 4/1987 Japan .
7201424 8/1973 Netherlands .

*Primary Examiner*—Deborah Yee
*Attorney, Agent, or Firm*—Finnegan, Henderson, Farabow, Garrett & Dunner

[57] ABSTRACT

A heat-resistant ferritic cast steel having excellent thermal fatigue resistance, consisting, by weight, of 0.25 to 0.45% C, 0.3 to 2.0% Si, not more than 1.0% Mn, 17 to 22% Cr, at least one kind selected from the group consisting of not more than 6% Co and not more than 1.5% Ni, the amount of % Co+3 % Ni being in the range of 1 to 6%, 0.006 to 0.1% of at least one kind selected from the group consisting of Y and rare earth elements, and the balance Fe and incidental impurities, the ferritic cast steel being composed of a structure in which $\alpha$ ferrite and $M_{23}C_6$ carbide are dispersed in $\delta$ ferrite. With this specific composition, even at high temperatures, there can be maintained the structure which has the $\alpha$ ferrite and the $M_{23}C_6$ dispersed in the $\delta$ ferrite, with the result that there is obtained an excellent thermal fatigue resistance, and in this structure, the transformation under heating will not occur even at a temperature of about 1,000° C. The steel of the present invention is particularly suited for a turbo rotor casing, an exhaust manifold, etc., of an automobile.

6 Claims, 1 Drawing Sheet

HEAT-RESISTANT FERRITIC CAST STEEL HAVING EXCELLENT THERMAL FATIGUE RESISTANCE

BACKGROUND OF THE INVENTION

This invention relates to a heat-resistant (ferritic) cast steel having excellent thermal fatigue resistance, which is used mainly to form a part subjected to repeated heating and cooling, such as a part of an automobile engine.

Recently, from the viewpoints of thermal fatigue resistance and economy, heat-resistant ferritic cast steel has been used as a material for an automobile engine part such as a precombustion chamber of a diesel engine, and various kinds of such cast steel have been proposed.

For example, Japanese Patent Examined Publication No. 46-18845 proposes a heat-resistant ferritic steel which is intended mainly to achieve improved deformation resistance and crank resistance, and consists of 0.05 to 0.40% C, 0.5to 1.0% Si, 0.2 to 1.0% Mn, 20.0 to 23.0% Cr, 0.5 to 2.5% Mo, 0.5 to 3.5% W, 0.5 to 3.5% Nb and the balance Fe and incidental impurities. Japanese Patent Unexamined Publication No. 48-52618 proposes a heat-resistant ferritic steel which has the same composition as that of the steel proposed in the above Japanese Patent Examined Publication No. 46-18845 except that instead of the W content, 1.0 to 4.0% Ni is contained in the steel in order to improve toughness and oxidation resistance. Japanese Patent Examined Publication No. 54-18647 proposes a heat-resistant ferritic cast steel which is obtained by containing 0.01 to 0.15% B and 0.01 to 0.15% Zr in the steel proposed in the above Japanese patent Unexamined Publication No. 48-52618. This heat-resistant ferritic cast steel of Japanese Patent Examined Publication No. 54-18647 exhibits a satisfactory crack resistance even when this steel is used in an engine subjected to a severer thermal load.

In order to mainly improve heat crack resistance and oxidation resistance, Japanese Patent Unexamined Publication 56-41354 proposes a heat-resistant ferritic steel consisting of 0.1 to 0.5% C, not more than 3.5% Si, not more than 2.0% Mn, not more than 12.0% Ni, 20 to 30% Cr and the balance Fe and incidental impurities, such a heat-resistant ferritic steel further containing a predetermined amount of at least one kind selected from the group consisting of Mo, W, Nb, V and Ti, such a heat-resistant ferritic steel further containing a predetermined amount of at least one kind selected from the group consisting of Cu, Co, B and R.E (rare earth element), and such a heat-resistant ferritic steel further containing a predetermined amount of S.

Japanese Patent Examined Publication No. 62-17021 proposes a heat-resistant ferritic steel which is inexpensive because Ni is not added, and has excellent crack resistance, and consists of 0.05 to 0.4% C, 0.05 to 2.0% Si, 0.05 to 2.0% Mn, 18.0 to 25.0% Cr, 0.01 to 0.50% Nb and the balance Fe and incidental impurities.

Japanese Patent Unexamined Publication No. 61-117251 proposes a heat-resistant ferritic steel which is intended mainly to achieve improved thermal fatigue resistance and consists of 0.05 to 0.40% C+N, 0.5 to 3.5% Si, not more than 2.0% Mn, 18.0 to 25.0% Cr, 0.2 to 2.0% Al, 0.1 to 1.5% of at least one kind selected from the group consisting of Nb, Ti and Zr, and the balance Fe and incidental impurities, and such a heat-resistant ferritic steel further containing a predetermined amount of at least one kind selected from the group consisting of Ni, Mo, W, V and B.

However, recently, in order to improve the performance of an engine, the temperature at which the engine part is used tends to become higher, and it has now been desired to provide heat-resistant cast steel of the type which is more excellent in thermal fatigue resistance and less costly than the heretofore-proposed heat-resistant steels.

SUMMARY OF THE INVENTION

It is therefore an object of this invention to provide heat-resistant ferritic cast steel (alloy) which is inexpensive and is more excellent in thermal fatigue resistance than the conventional alloys.

The inventors of the present invention have made a preliminary study of the relation between the structure of heat-resistant ferritic cast steel and its thermal fatigue resistance. As a result, it has been found that a ferritic alloy of such a structure in which both of $\alpha$ ferrite occurring through transformation from austenite during the casting and $M_{23}C_6$ carbide are dispersed in $\delta$ ferrite is more excellent in thermal fatigue resistance than a ferrite alloy composed mainly of $\alpha$ ferrite, when the upper limit of the use temperature is below an austenite-transformation point under heating. An object of the present invention has been achieved by adjusting the alloy composition in such a manner that the above structure can become predominant at the time of solidification and that the above structure can be stable in the use temperature range.

More specifically, the present invention provides a heat-resistant ferritic cast steel having excellent thermal fatigue resistance, which has a composition consisting, by weight, of 0.25 to 0.45% C, 0.3 to 2.0% Si, not more than 1.0% Mn, 17 to 22% Cr, at least one kind selected from the group consisting of not more than 6% Co and not more than 1.5% Ni, the amount of $\%Co+3\times\%Ni$ being in the range of 1 to 6%, 0.001 to 0.1% of at least one kind selected from the group consisting of Y and rare earth elements, and the balance Fe and incidental impurities, the ferritic cast steel being of such a structure that $\alpha$ ferrite and $M_{23}C_6$ carbide are dispersed in $\delta$ ferrite. Also, the present invention provides a heat-resistant ferritic cast steel having excellent thermal fatigue resistance which has a composition consisting, by weight, of 0.25 to 0.45% C, 0.3 to 2.0% Si, not more than 1.0% Mn, 17 to 22% Cr, at least one kind selected from the group consisting of not more than 6% Co and not more than 1.5% Ni, the amount of $\%Co+3\times\%Ni$ being in the range of 1 to 6%, at least one kind selected from the group consisting of not more than 5% W and not more than 2.5% Mo, the amount of $W+2\times\%Mo$ being not more than 5%, 0.001 to 0.1% of at least one kind selected from the group consisting of Y and rare earth elements, and the balance Fe and incidental impurities, the ferritic case steel being of such a structure that $\alpha$ ferrite and $M_{23}C_6$ carbide are dispersed in $\delta$ ferrite. With such a specified structure obtained by such limited composition, more excellent thermal fatigue resistance than that available with the conventional heat-resistant ferrite cast steels is achieved.

The type of steel of the present invention which contains 1 to 6% Co selected along from the group consisting of Co and Ni exhibits a particularly excellent thermal fatigue resistance, and is most preferred.

When Ni and Co are to be both added, it is preferred that the Ni content should be not more than 1%, with the amount of %Co+%Ni being in the range of 1 to 6%.

The steels as proposed in the above-mentioned Japanese Patent Examined Publication No. 18845/71, Laid-Open Patent Publication No. 52618/73 and Patent Examined Publication No. 18647/79 are of such a structure that α ferrite and $M_{23}C_6$ carbide are not dispersed in δ ferrite, and therefore such excellent thermal fatigue resistance as achieved in the present invention can not be obtained.

The alloy disclosed in the above-mentioned Japanese Laid-Open Patent Publication No. 41354/81 is described as having, in the cast state, a structure composed of a single phase of ferrite (i.e., δ ferrite) or a duplex structure composed of ferrite (δ ferrite) and austenite. Any of those steels specifically described in Examples of this prior art publication is not of such a structure that α ferrite and $M_{23}C_6$ carbide are dispersed in δ ferrite. Such a structure can not achieve such excellent thermal fatigue resistance as attained in the present invention.

Namely, the conditions of achievement of the object of the present invention are that the cast steel has the specified composition and that the α ferrite and the $M_{23}C_6$ carbide are dispersed in the δ ferrite. In these respects, the steel of the present invention is clearly distinguished from the conventional steels.

The reason why the thermal fatigue resistance is enhanced in the present invention is though to be that the propagation of cracks is suppressed by the interface (at which the $M_{23}C_6$ carbide usually precipitates) between the δ ferrite and the α ferrite.

Therefore, it is necessary that the α ferrite in the δ ferrite should be distributed in an amount enough to improve the thermal fatigue resistance, and it is also necessary that the $M_{23}C_6$ carbide should be present so that the structure can be stable in the use temperature range.

The amount of the α ferrite and the stability of the structure related to the temperature of the structure depend on the components of the alloy, and therefore it is necessary that the alloy components should be limited to their respective specified ranges as described in the present invention.

The reason for the specified components of the present invention will now be explained.

In the present invention, C is an indispensable element for producing the α ferrite and $M_{23}C_6$ carbide from the γ austenite, and the lower limit of its content needs to be 0.25%. If the C content exceeds 0.45%, if produces eutectic carbide to embrittle the alloy, and therefore the C content is limited to the range of between 0.25% and 0.45%.

Si serves as a deoxidizer, and also has an effect of improving the bonding of a Cr oxide film to enhance oxidation resistance. The lower limit of the Si content needs to be 0.3%, but if this content exceeds 2.0%, the amount of the δ ferrite in the structure becomes excessive, and as a result the effect of the dispersion of the α ferrite and the $M_{23}C_6$ carbide can not be achieved, so that the thermal fatigue strength is lowered. Therefore, the Si content should be limited to the range of between 0.3% and 2.0%. Preferably, the Si content should be in the range of between 0.7% and 1.6%.

A small amount of Mn is needed as a deoxidizer; however, if this is present in an excessive amount, oxidation resistance is lowered. Therefore, the Mn content should be limited to not more than 1.0%.

Cr imparts oxidation resistance to the alloy, and is an indispensable element for producing the structure in which the α ferrite and the $M_{23}C_6$ carbide are dispersed in the δ ferrite. The lower limit of the CR content needs to be 17%. If this content exceeds 22%, the amount of the δ ferrite becomes excessive to lower the thermal fatigue strength. Therefore, the Cr content should be limited to the range of between 17% and 22%. Preferably, the Cr content should be in the range of between 17.5% and 19.5%.

Co and Ni are important elements for the present invention, and serve to produce the α ferrite and the $M_{23}C_6$ carbide from the austenite through transformation during the solidification. Therefore, it is indispensable that at least one kind of the two should be present. Comparing Co with Ni, Ni has about three times greater effect than Co, and therefore the amount of addition of Co and Ni is calculated in terms of %Co+3×%Ni. With respect to the amount of Co and Ni, in order to achieve the above-mentioned effect, it is necessary that the amount of %Co+3×%Ni should be not less than 1%; however, if this amount is excessive, the austenite phase becomes stable so that the transformation does not occur, and as a result the α ferrite and the $M_{23}C_6$ carbide are not produced. Therefore, the Ni content should be not more than 1.5%, and the Co content should be not more than 6%, and also the amount of %C+3×%Ni should be not more than 6%.

As compared with Co, Ni has a greater effect of lowering the austenite transformation temperature during heating, and has an excessive effect of quenchability. Therefore, Ni suppresses the transformation (by which the α ferrite and the $M_{23}C_6$ carbide are produced) and causes martensite transformation to be apt to occur. Therefore, particularly in the case of use in a high temperature range, it is most preferred to use Co alone. However, if the Ni content is not more than 1%, it may be replaced by a three times larger amount of Co, in which case the Ni content is not more than 1%, the Co content is not more than 6%, and the amount of %Co+3×%Ni is in the range of between 1% and 6%. In this case, the properties are not so markedly degraded, and therefore this may be desirable in view of the cost.

Y and other rare earth elements (R.E), when present even in a small amount, fill in atom vacancies in the Cr oxide film to enhance the oxidation resistance; however, if they are present in an excessive amount, they produce an eutectic crystal to embrittle the grain boundary. Therefore, the amount should be limited to the range of between 0.001% to 0.1%.

W and Mo serve to suppress the diffusion to make fine in size and stabilize the structure, and are equivalent in that they are effective in enhancing the thermal fatigue strength. It is preferred that one or both of W and Mo should be added to the basis composition of the present invention. Moreover, if they are present in an excessive amount, the amount of the α ferrite becomes excessive. Therefore, the W equivalent amount (%W 2×%Mo) should be limited to not more than 5%. It is preferred that W should be added alone in the range of between 2% and 3%.

In the alloy of the present invention, the MC carbide-producing elements such as Ti, V, Nb and Ta are not always necessary. However, so long as such elements are added in such a range as not to make the amount of C insufficient, they are not particularly harmful, and therefore a small amount of such elements (Ti, V: not more than 0.2%; Nb: not more than 0.4%; Ta: not more than 0.8%) can be allowed to be added.

Also, grain boundary-reinforcing elements such as B and Zr are not always necessary for the alloy of the present invention, but a small amount (B: not more than 0.03%; Zr: not more than 0.2%) can be added since such small amount is not harmful.

DESCRIPTION OF THE PREFERRED EMBODIMENTS OF THE INVENTION

Figure 1:
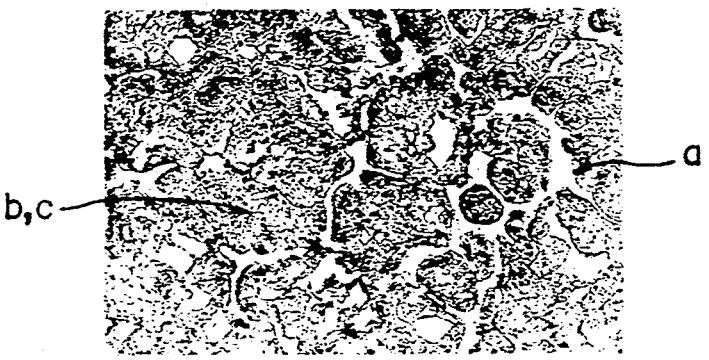
FIGS. 1 to 3 are photographs showing structures of steels of the present invention.

The invention will now be described by way of the following Example.

Alloys shown in Table 1 were melted in the atmosphere and were cast into Y blocks in the atmosphere. These blocks were annealed at 800° C. for 5 hours, and then test pieces were cut from the blocks, and then a thermal fatigue test and an oxidation resistance test were carried out. In the thermal fatigue test, the opposite ends of the test piece which had the overall length of 160 mm and a cylindrical portion of 8 mm diameter×24 mm length, were fixed, and the cylindrical portion was heated to 900° C., maintained at this temperature for 6 minutes and then allowed to cool. This thermal cycle until the test piece was ruptured was determined. In the oxidation resistance test, a pair of test pieces (10 mm diameter×20 mm length were heated at 1,000° C. for 200 hours, and then scales were removed from the test pieces, and then the average amount of reduction of the weight of the test piece was determined. The results obtained are also shown in Table 1. Also, a thermal expansion measurement up to the temperature of 1,000° C. was made so as to determine whether or not the transformation into austenite under heating occurred. The results thereof are also shown in Table 1.

TABLE 1

| Example No. | | Chemical composition (wt. %) C | Si | Mo | Cr | Ni | Co | Mo | W | Y | other | Number of thermal cycle unit thermal fatigue rupture (900° C.) | Weight reduction by oxidation (mg/cm²) | Transformation under heating below 1000° C. |
|---|---|---|---|---|---|---|---|---|---|---|---|---|---|---|
| Alloys of present invention | 1 | 0.27 | 1.1 | 0.4 | 19.6 | — | 3.0 | — | — | 0.01 | | 112 | 12.0 | None |
| | 2 | 0.36 | 1.4 | 0.5 | 18.3 | — | 3.3 | — | 2.1 | 0.01 | — | 119 | 14.4 | None |
| | 3 | 0.34 | 0.9 | 0.6 | 18.7 | — | 5.6 | 1.3 | 2.2 | 0.01 | — | 128 | 13.7 | None |
| | 4 | 0.27 | 1.0 | 0.5 | 21.3 | 0.9 | 2.5 | — | — | 0.01 | — | 105 | 9.5 | None |
| | 5 | 0.33 | 0.8 | 0.7 | 17.4 | 0.2 | 1.1 | — | 4.3 | 0.01 | — | 131 | 15.8 | None |
| | 6 | 0.41 | 0.5 | 0.9 | 19.5 | 0.5 | 4.3 | 2.2 | — | 0.01 | — | 115 | 12.5 | None |
| | 7 | 0.35 | 1.0 | 0.8 | 21.5 | 1.3 | — | — | 4.5 | — | RE 0.03 | 103 | 11.0 | None |
| | 8 | 0.31 | 1.8 | 0.6 | 18.7 | 0.1 | 2.9 | — | 2.4 | 0.02 | | 110 | 13.8 | None |
| | 9 | 0.32 | 1.3 | 0.6 | 18.6 | 0.1 | 2.9 | — | 2.3 | 0.02 | | 126 | 12.7 | None |
| Comparative alloys | 11 | 0.33 | 1.0 | 0.5 | 19.2 | — | — | — | — | — | | 79 | 38.5 | Occurred |
| | 12 | 0.43 | 1.2 | 0.7 | 21.4 | 1.9 | — | — | — | — | | 75 | 27.4 | Occurred |
| | 13 | 0.22 | 1.0 | 0.5 | 23.0 | — | — | — | — | — | Nb 0.2 | 66 | 8.0 | None |
| | 14 | 0.43 | 1.3 | 0.4 | 18.0 | 1.1 | 3.1 | — | — | — | | 76 | 47.6 | Occurred |
| | 15 | 0.35 | 1.0 | 0.5 | 25.2 | 0.1 | 1.0 | 0.5 | — | — | Nb 0.3 | 65 | 8.5 | None |

It will be appreciated from Table 1 that as compared with the comparative alloys (Sample Nos. 11 to 15), the alloys of the present invention (Sample Nos. 1 to 9) are far higher in thermal fatigue resistance and have a good oxidation resistance. The fact that the transformation does not occur up to 1,000° C. indicates that the alloys can be used at high temperatures of up to about 1,000° C.. A comparison of the alloys of the present invention with the comparative alloys Nos. 11, 12 and 14 indicates that the alloys of the present invention are superior in oxidation resistance. This is achieved by the effect of Y. Steel with the high Cr content, such as the comparative alloys Nos. 13 and 15, has a good oxidation resistance without the addition of Y, but is inferior in thermal fatigue resistance because its structure is composed mainly of δ ferrite.

Figure 2:
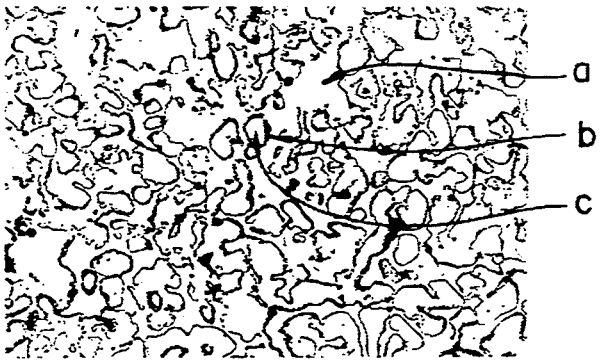
Figure 3:
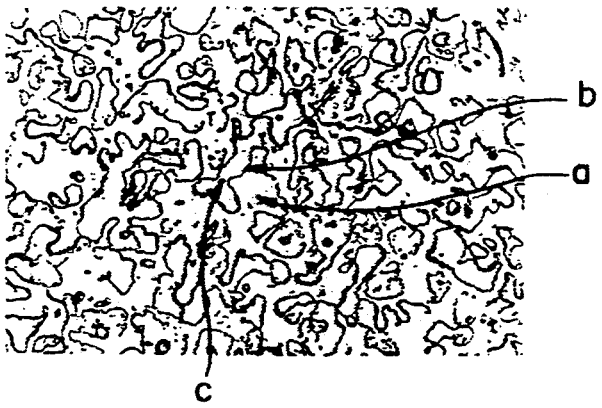

Photographs showing micro-structures of the Present alloys of Sample Nos. 2, 9 and 8 are shown in FIGS. 1, 2 and 3, respectively.

In these Figures, the α ferrite portion is indicated by arrow a, the $M_{23}C_6$ carbide is indicated by arrow b, and the α ferrite portion is indicated by arrow c.

It will be appreciated from these Figures that in the structure of the alloys of the present invention, the α ferrite and the $M_{23}C_6$ carbide are dispersed in the δ ferrite.

It has been confirmed that the $M_{23}C_6$ carbide is either present in the eutectoid structure (FIG. 1) in which the $M_{23}C_6$ carbide is dispersed in the α ferrite, or present in the structure (FIGS. 2 and 3) in which the $M_{23}C_6$ carbide agglomerates in the vicinity of the interface between the α ferrite and the δ ferrite.

The steels of the present invention are equal to or higher than the conventional alloys in oxidation resistance, and have remarkably improved thermal fatigue properties over the conventional alloys. Therefore, when the steel of the present invention is used to form heat-resistant parts of an automobile, such as a precombustion chamber of a diesel engine, portion, a turbo rotor casing, exhaust manifold, etc., such part can be used under a higher-temperature condition that under a temperature condition in which the conventional materials have been used.

What is claimed is:

1. A heat-resistant ferritic cast steel having excellent thermal fatigue resistance, consisting, by weight, of 0.25 to 0.45% C, 0.3 to 2.0% Si, not more than 1.0% Mn, 17 to 22% Cr, at least one kind selected from the group consisting of not more than 6% Co and not more than 1.5% Ni, the amount of %Co+3×%Ni being in the range of 1 to 6%, 0.001 to 0.1% of at least one kind selected from the group consisting of Y and rare earth elements, and the balance Fe and incidental impurities, said ferritic cast steel being composed of a structure in which α ferrite and $M_{23}C_6$ carbide are dispersed in δ ferrite.

2. A heat-resistant ferritic cast steel having excellent thermal fatigue resistance, consisting, by weight, of 0.25 to 0.45% C, 0.3 to 2.0% Si, not more than 1.0% Mn, 17 to 22% Cr, at least one kind selected from the group consisting of not more than 6% Co and not more than 1.5% Ni, the amount of %Co+3×%Ni being in the range of 1 to 6%, at least one kind selected from the group consisting of not more than 5% W and not more than 2.5% Mo, the amount of %W+2 x %Mo being not more than 5%, 0.001 to 0.1% of at least one kind selected from the group consisting of Y and rare earth elements, and the balance Fe and incidental impurities, said ferritic cast steel being composed of structure in which α ferrite and $M_{23}C_6$ carbide are dispersed in δ ferrite.

3. A heat-resistant ferritic cast steel having excellent thermal fatigue resistance, consisting, by weight, of 0.25 to 0.45% C, 0.3 to 2.0% Si, not more, than 1.0% Mn, 17 to 22% Cr, 1 to 6% Co, 0.001 to 0.1% of at least one kind selected from the group consisting of Y and rare earth elements, and the balance Fe and incidental impurities, said ferritic cast steel being composed of a structure in which α ferrite and $M_{23}C_6$ carbide are dispersed in δ ferrite.

4. A heat-resistant ferrite cast steel having excellent thermal fatigue resistance, consisting, by weight, of 0.25 to 0.45% C, 0.3 to 2.0% Si, not more than 1.0% Mn, 17 to 22% Cr, 1 to 6% Co, at least one kind selected from the group consisting of not more than 5% W and not more than 2/5% Mo, the amount of %W+2×%Mo being not more than 5%, 0.001 to 0.1% of at least one kind selected from the group consisting of Y and rare earth elements, and the balance Fe and incidental impurities, said ferritic cast steel being composed of a structure in which α ferrite and $M_{23}C_6$ carbide are dispersed in δ ferrite.

5. A heat-resistant ferrite cast steel having excellent thermal fatigue resistance, consisting, by weight, of 0.25 to 0.45% C, 0.3 to 2.0% Si, not more than 1.0% Mn, 17 to 22% Cr, at least one kind selected from the group consisting of not more than 6% Co and not more than 1.0% Ni, the amount of %Co+3×%Ni being in the range of 1 to 6%, 0.001 to 0.1% of at least one kind selected from the group consisting of Y and rare earth elements, and the balance Fe and incidental impurities, said ferritic cast steel being composed of a structure in which α ferrite and $M_{23}C_6$ carbide are dispersed in δ ferrite.

6. A heat-resistant ferritic cast steel having excellent thermal fatigue resistance, consisting, by weight, of 0.25 to 0.45% C, 0.3 to 2.0% Si, not more than 1.0% Mn, 17 to 22% Cr, at least one kind selected from the group consisting of not more than 6% Co and not more than 1% Ni, the amount of %Co+3×%Ni being in the range of 1 to 6%, at least one kind selected from the group consisting of not more than 5% W and not more than 2.5% Mo, the amount of %W+2 x %Mo being not more than 5%, 0.005 to 0.1% of at least one kind selected from the group consisting of Y and rare earth elements, and the balance Fe and incidental impurities, said ferritic cast steel being composed of a structure in which α ferrite and $M_{23}C_6$ carbide are dispersed in δ ferrite.

* * * * *

UNITED STATES PATENT AND TRADEMARK OFFICE

CERTIFICATE OF CORRECTION

PATENT NO. : 5,096,514

DATED : March 17, 1992

INVENTOR(S) : Rikizo Watanabe et al.

It is certified that error appears in the above-identified patent and that said Letters Patent is hereby corrected as shown below:

Claim 2, column 7, lines 3-4, "1." and "5%" have been improperly divided and should appear on line 4 as --1.5%--.

Column 6,
In Table 1, in the heading of the 12th column, line 2, "unit" should read --until--.

Signed and Sealed this

Fifth Day of October, 1993

*Attest:*

*Attesting Officer*

BRUCE LEHMAN

*Commissioner of Patents and Trademarks*